US006843243B2

(12) United States Patent
Steurer

(10) Patent No.: US 6,843,243 B2
(45) Date of Patent: Jan. 18, 2005

(54) MOTORIZED GAS LOCKOUT VALVE FOR GAS RANGE

(75) Inventor: Brian M. Steurer, Ringgold, GA (US)

(73) Assignee: General Electric Company, Schenectady, NY (US)

( * ) Notice: Subject to any disclaimer, the term of this patent is extended or adjusted under 35 U.S.C. 154(b) by 13 days.

(21) Appl. No.: 10/065,395

(22) Filed: Oct. 11, 2002

(65) Prior Publication Data

US 2004/0069293 A1 Apr. 15, 2004

(51) Int. Cl.[7] ..... F23D 11/36; F24C 3/12
(52) U.S. Cl. ..... 126/42; 126/39 G; 431/153
(58) Field of Search ..... 126/42, 39 N, 126/39 R, 39 G; 431/153

(56) References Cited

U.S. PATENT DOCUMENTS 5,241,463 A * 8/1993 Lee ..... 700/90
5,244,379 A * 9/1993 Stirling et al. ..... 431/6
5,400,766 A 3/1995 Dillon
5,429,111 A * 7/1995 Akamatsu ..... 126/52
5,611,327 A * 3/1997 Teixeira Filho et al. .. 126/39 R
5,655,900 A * 8/1997 Cacciatore ..... 431/70
5,662,465 A 9/1997 Kano
5,694,916 A 12/1997 Gambill et al.
5,875,773 A 3/1999 Jansen
6,000,390 A 12/1999 Evers et al.
6,126,435 A * 10/2000 Fredin-Garcia et al. ..... 431/14

FOREIGN PATENT DOCUMENTS

GB 2 081 870 * 2/1982

* cited by examiner

*Primary Examiner*—Alfred Basichas
(74) *Attorney, Agent, or Firm*—George L. Rideout, Jr.; Armstrong Teasdale LLP

(57) ABSTRACT

A gas cooking appliance includes at least one gas cooking element and a gas lockout valve assembly in line with the at least one gas cooking element. The gas lockout valve assembly includes a valve and a motor configured to open or close the valve.

20 Claims, 6 Drawing Sheets

MOTORIZED GAS LOCKOUT VALVE FOR GAS RANGE

BACKGROUND OF INVENTION

This invention relates generally to gas cooking appliances, and, more particularly, to a gas shutoff valve assembly for a cooking appliance.

Gas fired stoves, ovens, and ranges typically include one or more gas heating elements coupled to a main gas line to the appliance and providing fuel to the heating elements, sometimes referred to as burners. In a domestic range, a gas line is connected to a distribution manifold within the appliance to direct gas to a plurality of surface burner elements on a cooktop or to baking elements within an oven cavity. Operation of the burners and cooking elements is usually accomplished with burner control knobs mounted on the front wall of the appliance in front of the cooktop. When a control knob is actuated, fuel is supplied to associated heating elements and an ignition module creates a spark to ignite the gas and produce a flame.

Unfortunately, the control knobs are often readily accessible to persons who are not able to safely operate the oven. For instance, an unsupervised child may turn the control knobs and light the burners or in some cases cause continuous flow of natural or propane gas that has not been lit, both of which are highly dangerous and undesirable conditions. Certain adults with mental conditions, including but not limited to dimensia, senility or Alzheimers disease, may also unwittingly or forgetfully activate the gas control knobs and light the burners or introduce highly combustible gas into the room.

To address these concerns, some gas fired cooking appliances include a valve to prevent gas flow to the burners when actuated (sometimes referred to as a lockout condition), and thus the appliance can be rendered inoperable as desired In some known appliances, however, mechanical controls for the lockout valve are rather easily accessible to appliance users. See, for example, U.S. Pat. No. 5,649,916. Consequently, the gas lockout valves themselves can be manipulated or relatively easily defeated by persons who are unable to use the appliance safely, resulting in potentially hazardous operating conditions.

One type of appliance includes a remotely actuated gas safety valve including a solenoid that is used to shutoff gas flow to the manifold which supplies gas to the multiple burners and heating units of the appliance. See, for example, U.S. Pat. No. 6,000,390. Solenoid operated valves, however, can be disadvantaged in several aspects.

For example, a normally closed fail safe solenoid valve must be continuously energized to supply gas to the heating elements whenever the control lockout feature is not activated, regardless of whether or not the appliance is actually used. Continuous energization of a solenoid is undesirable from both an energy consumption and appliance reliability perspective. Additionally, an AC solenoid produces an audible hum that may detract from the kitchen environment when the lockout feature is activated. While the hum of an AC solenoid may be eliminated by using a DC solenoid, a DC solenoid requires rectified AC power, which increases costs and introduces component reliability issues. Further, because the solenoid valve must be continuously energized to supply gas to the heating elements, the gas cooktop and gas heating elements become inoperable during a power outage. If the appliance is in use when power is lost, the denergized solenoid closes the valve and cuts off the gas fuel supply, and when power is restored the solenoid may become energized and open the valve, which will emit fuel into the room. While this problem may be overcome with electronic controls to prevent the solenoid from opening the valve when power is restored, the electronic controls introduce additional cost and complexity to the appliance control scheme. Still further, in existing systems it is sometimes difficult to determine whether the solenoid is activated or deactivated, and consequently whether the lockout system is properly functioning.

SUMMARY OF INVENTION

In one aspect, a gas cooking appliance is provided. The appliance comprises at least one gas cooking element and a gas lockout valve assembly in line with said at least one gas cooking element. The gas lockout valve assembly comprises a valve and a motor configured to open or close the valve.

In another aspect, a gas fired cooktop is provided. The cooktop comprises at least one gas burner, at least one control knob associated with said at least one burner, and a motorized gas lockout valve coupled to said at least one gas burner and establishing a gas supply connection thereto. The valve is positionable in a gas lockout position, thereby rendering said control knob ineffective to operate said burner.

In another aspect, a gas range is provided. The range comprises a cabinet, a plurality of gas heating elements coupled to said cabinet, a gas manifold within said cabinet and configured to distribute gas to each of said heating elements, and a motorized gas lockout assembly coupled in line with said gas manifold. The motorized gas lockout assembly is positionable to permit or deny gas flow to said gas manifold.

In still another aspect, a gas range is provided. The range comprises a cabinet, a plurality of gas heating elements coupled to said cabinet, a gas manifold within said cabinet and configured to distribute gas to each of said heating elements and a gas lockout assembly coupled in line with said gas manifold. The gas lockout assembly comprises a valve, a motor coupled to and in driving relation to said valve and opening and closing a flow path through the valve to permit or prevent gas flow to said gas manifold, and a cam coupled to said valve and indicating a position of said valve.

DETAILED DESCRIPTION

Figure 1:
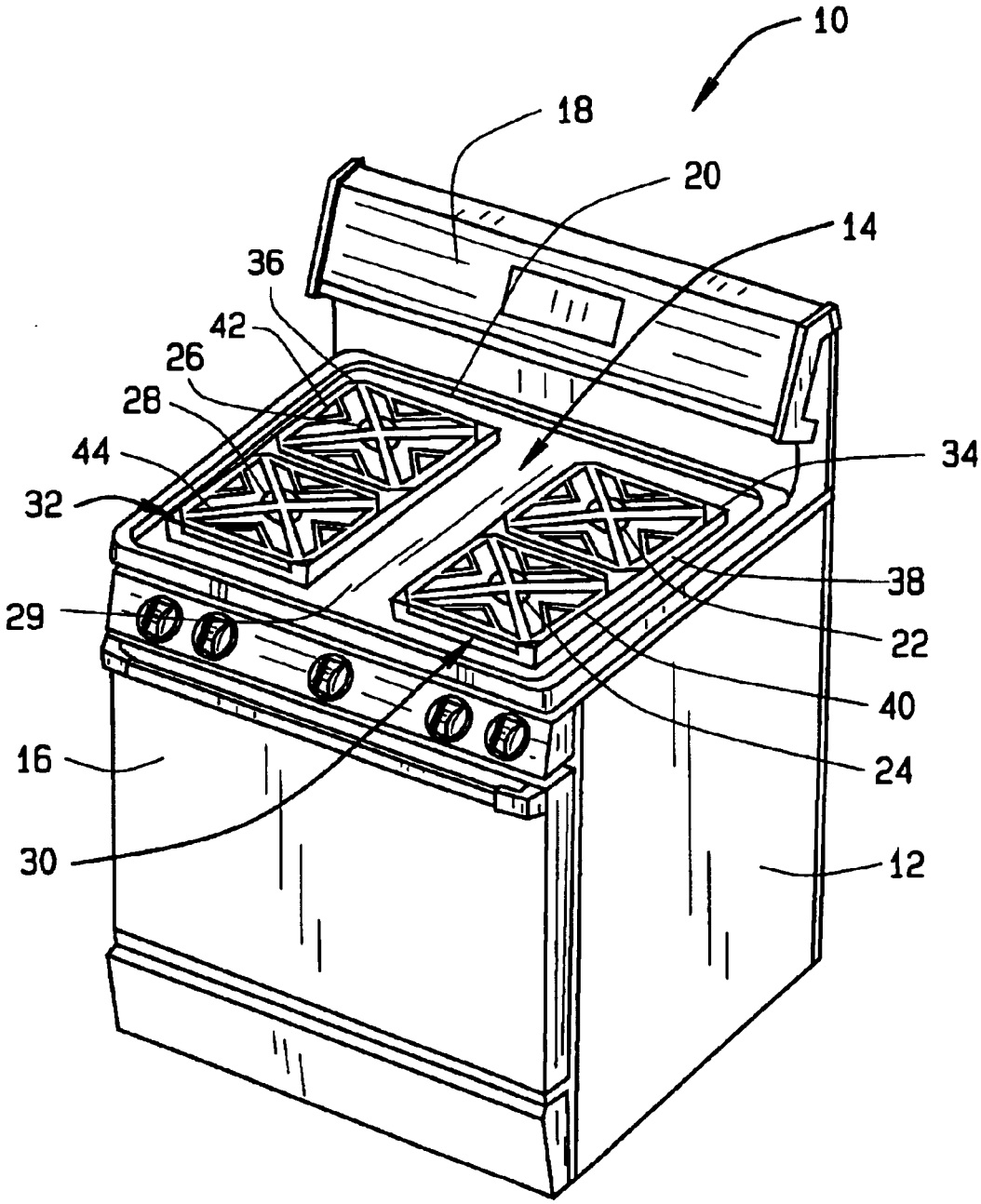
FIG. 1 illustrates an exemplary free standing gas range.

FIG. 1 illustrates a gas cooking appliance in the form of a free standing gas range 10 including an outer body or cabinet 12 that incorporates a generally rectangular cooktop 14. An oven, not shown, is positioned below cooktop 14 and has a front-opening access door 16. A range backsplash 18 extends upward of a rear edge 20 of cooktop 14 and contains various control selectors (not shown) for selecting operative features of heating elements for cooktop 14 and the oven. It is contemplated that the present invention is applicable, not only to cooktops which form the upper portion of a range, such as range 10, but to other forms of cooktops as well, such as, but not limited to, free standing cooktops that are mounted to kitchen counters. Therefore, gas range 10 is provided by way of illustration rather than limitation, and accordingly there is no intention to limit application of the present invention to any particular appliance or cooktop, such as range 10 or cooktop 14. In addition, it is contemplated that the present invention is applicable to duel fuel cooking appliances, e.g., a gas cooktop with an electric oven.

Cooktop 14 includes four gas fueled burners 22, 24, 26, 28 which are positioned in spaced apart pairs 22, 24 and 26, 28 positioned adjacent each side of cooktop 14. Each pair of burners 22, 24 and 26, 28 is surrounded by a recessed area (not shown in FIG. 1) respectively, of cooktop 14. The recessed areas are positioned below the upper surface 29 of cooktop 14 and serve to catch any spills from cooking utensils being used with cooktop 14. Each burner 22, 24, 26, 28 extends upwardly through an opening in cooktop 14, and a grate assembly 30, 32 is positioned over each respective pair of burners, 22, 24 and 26, 28. Each grate assembly 30, 32 includes a respective frame 34, 36, and separate utensil supporting grates 38, 40, 42, 44 are positioned above the cooktop recessed areas and overlie respective burners 22, 24, 26, 28 respectively.

The construction and operation of the range heating elements, including cooktop gas burners 22, 24, 26, 28 are believed to be within the purview of those in the art without further discussion.

Figure 2:
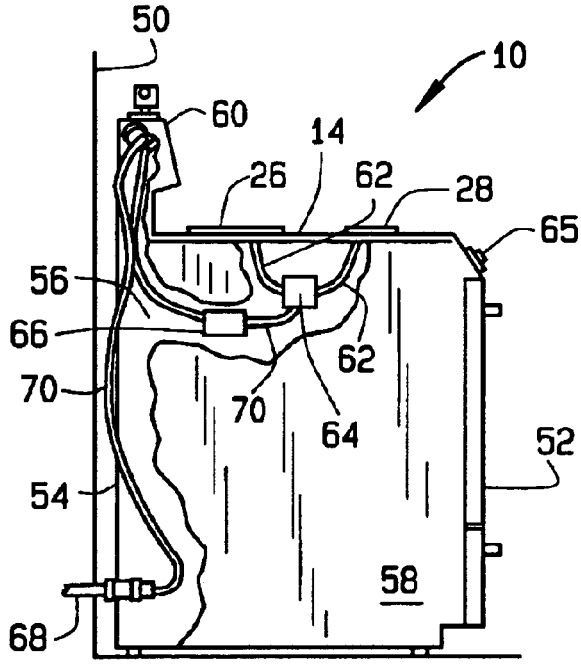
FIG. 2 is a side elevational view of the range shown in FIG. 1 partly broken away.

FIG. 2 illustrates range 10 mounted adjacent a kitchen wall 50. Range 10 includes a front wall 52, a rear wall 54, laterally spaced side walls 56 and 58, and a backsplash 60. Gas burners 26, 28 of cooktop 14 are connected by a gas line 62 to a manifold 64. A plurality of burner knobs 65 are mounted on a front panel of range 10 in front of cooktop 14. A gas appliance connector hose 70 is connected between main gas line 68 and a gas line manifold 64, and a motorized gas lockout valve assembly 66 is connected to or in line with a gas line manifold 64 along line 70. Gas lockout valve assembly 66 therefore regulates gas flow between main gas line 78 and gas manifold 64. While lockout valve assembly 66 is illustrated coupled to line 70 between backsplash 60 and manifold 64, it is contemplated that motorized gas lockout assembly 66 may be located elsewhere in appliance 10, including but not limited to a location in the immediate vicinity of the main gas line connection to appliance 10.

When motorized lockout valve assembly 66 is in an open position, gas flow is unimpeded through gas line 70 to manifold 64 and to burners 26, 28 when the applicable control knob 65 is actuated. When motorized lockout valve assembly 66 is in a closed position, gas flow is prevented into gas manifold 64 from gas line 70, thereby blocking gas flow to burners 26, 28 even though the applicable control knob 65 may be opened. Burners 26, and 28 (as well as burners 22 and 24 shown in FIG. 1 and other heating elements connected to manifold 64) are thereby inoperative and dangerous gas flow is avoided. It can therefore be assured that persons unable to use range 10 safely will not create hazardous conditions by manipulating control knobs for the gas heating elements.

Figure 3:
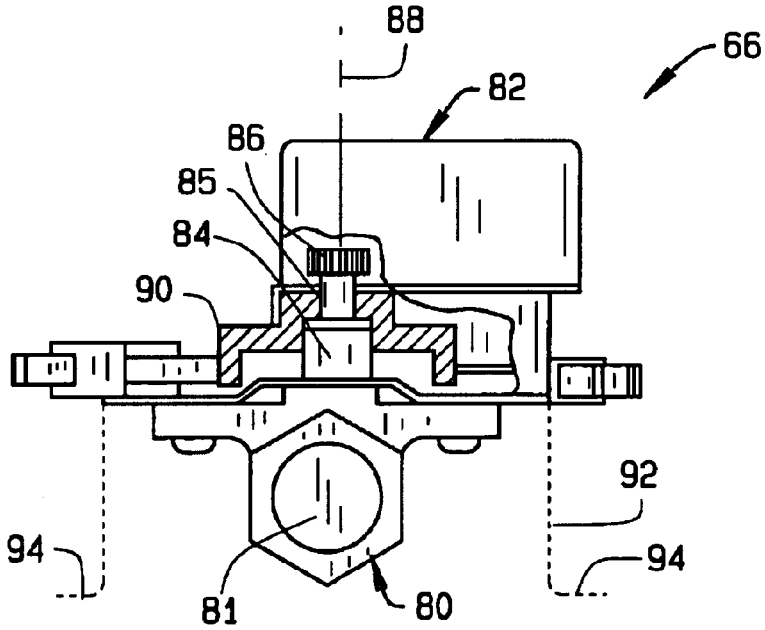
FIG. 3 is a cross sectional schematic view of a first embodiment of a gas lockout valve assembly for the range shown in FIGS. 1 and 2.

FIG. 3 is a cross sectional schematic view of an exemplary embodiment of a motorized gas lockout valve assembly 66 including a valve 80 adapted for connection to a gas line, such as gas line 70 (shown in FIG. 2) and an electric motor 82 for actuating valve 80 to open or close a fluid path or passage 81 through valve 80 to supply or not supply gas to appliance gas manifold 64 (shown in FIG. 2) and therefore to associated range heating elements. In an illustrative embodiment, valve 80 is a ½ inch NPT panel mount ball valve including an actuation shaft 84 rotatable about an axis 88 through the valve. Valve shaft 84 is operatively coupled to motor 82, and more specifically to a motor output shaft 85 extending from a motor output gear 86 through a cam 90 that receives motor shaft 85 and valve shaft 84. As motor 82 is energized, motor shaft 85 is rotated and causes valve shaft 84 to be rotated. As valve shaft 84 is rotated, a spherical valve element mechanism is displaced from or seated to valve seats within a flow path to control the flow of gas through valve 80. It is believed that such valve mechanisms are readily appreciated by those in the art without further explanation, and it is contemplated that other types of valves familiar to those in the art could likewise be employed without departing from the scope of the present invention.

Motor 82 is operatively coupled to valve shaft 84 through a cam 90 coupled to valve shaft 84 and therefore rotating with shaft 84 for valve control purposes explained below. In an illustrative embodiment, motor 82 is a low cost, low speed (e.g., single digit revolutions per minute when energized, and specifically two revolutions per minute in one embodiment) electric motor. When motor 82 is energized upon command, valve shaft 84 is rotated to open or close valve 80 and to regulate gas flow therethrough. The construction and operation of such a motor 82 is believed to be within the purview of those in the art without further explanation.

In one embodiment, valve 80 and motor 82 are coupled to a mounting plate 92 (shown in phantom in FIG. 3) including feet 94 for attachment to a frame or cabinet of an appliance, such as range 10 (shown in FIGS. 1 and 2). In an illustrative embodiment, mounting plate 92 is a metal plate formed by known processes and techniques, including but not limited to stamping and casting operations.

Figure 4:
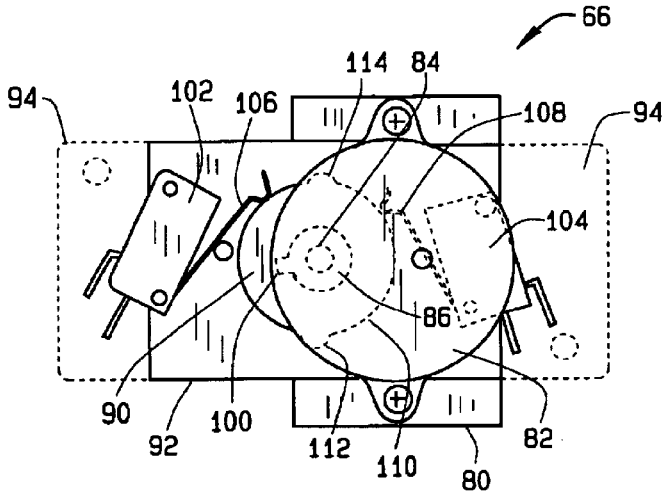
FIG. 4 is a top plan schematic view of the valve assembly shown in FIG. 3.

FIG. 4 is a top plan schematic view of valve assembly 66 illustrating motor 82 attached to mounting plate 92 and to valve 80. Motor output shaft 85 (shown in FIG. 3) is engaged or coupled to cam 90 in driving relation with a radially projecting valve key 100. Thus, as motor shaft 85 is rotated when motor 82 is energized, valve shaft 84 is also rotated to open and close the fluid passage through valve 80.

Additionally, and to ensure correct positioning of the valve (i.e., open or shut as desired), valve assembly 66 includes first and second microswitches 102, 104 coupled to mounting plate 92. Each microswitch, 102, 104 includes a movable contact arm 106, 108, respectively in contact with an outer surface 110 of cam 90. In an exemplary embodiment, cam outer surface 110 is substantially circular and includes radial projections or high points 112, 114 extending outwardly from cam outer surface 110 approximately 180 radial degrees from one another. Contact arms 106, 108 of microswitches 102, 104 include hooked ends that are biased against and in sliding contact with cam outer surface 110, and in the illustrated embodiment the hooked ends of switch contact arms 106, 108 are located approximately 90 radial degrees from one another about cam outer surface 110.

As valve shaft 84 is rotated, cam 90 is also rotated, and cam high points 112, 114 contact hooked ends of microswitch contact arms 106, 108 that rest upon cam outer surface 110. The cam surface high points 112, 114 displace the microswitch contact arms 106, 108 and trip the respective microswitches 102, 104. Thus, when microswitches 102, 104 are coupled to a controller (not shown in FIG. 4), the controller may sense an operating state (i.e., whether valve 80 is opened or closed to prohibit gas supply to heating elements) of valve assembly 66. Additionally, switch and motor failure may be detected and an audible or visual warning may provided to an appliance user.

In the illustrated embodiment, valve 80 is constructed so that one complete rotation of valve shaft 84 about axis 88 (shown in FIG. 3) opens and closes a passage through the valve two times. Thus, each 180° rotation of cam 90 signifies one complete stroke of valve 80. As an example, and assuming a counter-clockwise rotation of cam 90 in FIG. 4, when cam surface high point 114 contacts switch arm 106, switch 102 may signal the controller that valve 80 is opened, while when contact arm 108 is displaced by cam surface high point 112, switch 104 may signal the controller that valve 80 is closed and in a lockout position to prevent gas supply to appliance cooking elements. In turn, the controller may provide positive feedback to a user, as described below, to positively indicate a state of gas lockout valve assembly 66.

It is recognized that in alternative embodiments employing other valve constructions, cam surface 110 and microswitch orientations (i.e., positions of the contact arm ends) will require appropriate adjustment to accomplish sensing of open and closed positions of the valve. Further, it is contemplated that position sensing of the valve could be accomplished using only one of microswitches 102, 104 in the illustrated embodiment.

Motor 82 is briefly energized only when a gas control lockout feature is activated to close the valve or deactivated to open the valve, and in comparison to a solenoid actuated valve that must be continuously energized motor 82 is energy efficient. Also, motor 82 is quiet and because it is energized only briefly to open or close valve 80, valve assembly 66 avoids an audible hum of a continuously energized solenoid Further, cost and reliability issues associated with solenoids and related components (e.g., rectifiers, etc.) are avoided.

Moreover, and unlike known solenoid actuated valves, valve assembly 66 will not shut off the gas supply during a power outage, and the appliance cooking elements can therefore be operated in a power outage provided that the lockout feature was not activated to close valve 80 when power is lost. Safety concerns due to disrupted cooking when power is lost and emission of unignited gas into the room when power is restored are therefore avoided, together with associated electronic controls to safeguard against power failure conditions used with solenoid actuated valves.

Still further, and in an illustrative embodiment, the gas lockout valve feature is implemented in a readily observable control scheme to clearly indicate a gas lockout condition, while still providing adequate safeguards to prevent dangerous oven operation by children and adults who are incapable of safely operating the gas heating elements.

Figure 5:
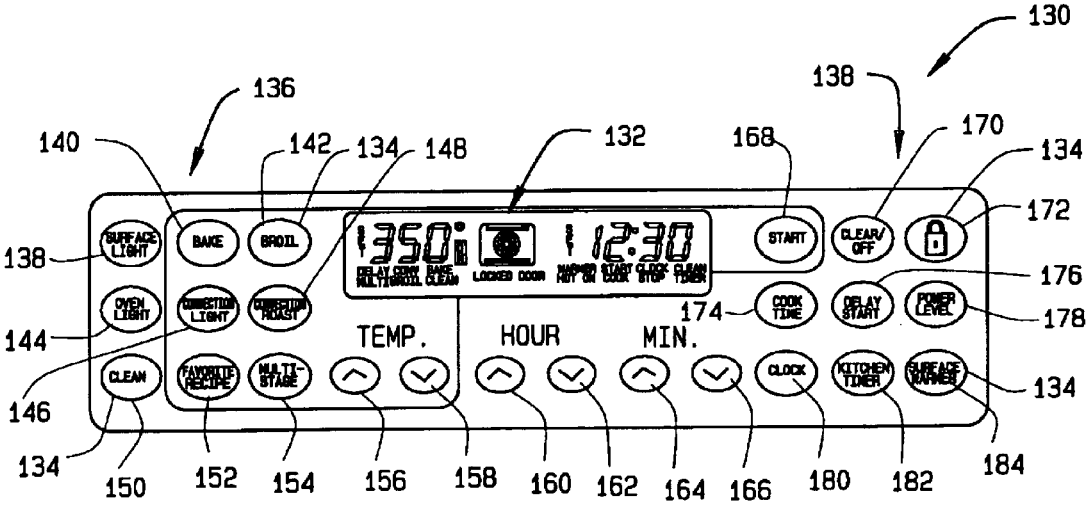
FIG. 5 is a plan view of a control panel interface for the range shown in FIGS. 1 and 2.

FIG. 5 illustrates an exemplary input interface panel 130 for range 10 (shown in FIGS. 1 and 2). Interface panel 130 includes a display 132 and a plurality of input selectors 134 in the form of touch sensitive buttons or keypads for accessing and selecting oven features. In alternative embodiments, other known input selectors are used in lieu of touch sensitive switches.

More specifically, input selectors 134 are divided into two groups 136, 138. Group 136 includes a SURFACE LIGHT keypad 138, a BAKE keypad 140, a BROIL keypad 142, an OVEN LIGHT keypad 144, a CONVECTION BAKE keypad 146, a CONVECTION ROAST keypad 148, a CLEAN keypad 150, a FAVORITE RECIPE keypad 152, a MULTI-STAGE keypad 154, a temperature up (⊥) slew keypad 156 and a temperature down (⊢) slew keypad 158. Group 138 includes an hour up (⊥) slew keypad 160 and an hour down (⊢) slew keypad 162, a minute up (⊥) slew keypad 164 and a minute down (⊢) slew keypad 166, a START keypad 168, a CLEAR/OFF keypad 170, a LOCK keypad 172, a COOK TIME keypad 174, a DELAY START keypad 176, a POWER LEVEL keypad 178, a CLOCK keypad 180, a KITCHEN TIMER keypad 182, and a SURFACE WARMER keypad 184.

By manipulating the appropriate input selector 134 in one of the control selector groups 136, 138, the appropriate feature or function is activated by an appliance controller (not shown in FIG. 5) and, for most of the features, an icon or indicator is displayed on display 132 to visually indicate selected appliance features and operating parameters, such as cooking time, cooking temperature, etc.

In the illustrated embodiment, a designated key, such as lock key 172 may be manipulated to activate a gas lockout feature and cause gas lockout valve assembly 66 (shown in FIGS. 3 and 4) to be closed in the lockout position preventing gas flow to the gas heating elements. Additionally, a LOCKED indicator is displayed in display 132 when the lockout feature is implemented. Thus, the gas lockout feature is rather easily entered and conspicuously indicated to enable or disable the gas lockout feature.

In a further embodiment, a combination of input selectors 134 may be required to unlock the lockout feature. For instance, a user may be required to depress LOCK key 172, CLEAR/OFF key 170 and START key 168 in a designated sequence and within a predetermined time frame to deactivate the lockout feature. In another embodiment, a press and hold operation may be required to deactivate the lockout feature by depressing one or more keys for at least a minimum time period to disable the lockout feature. By strategically selecting the key combinations and times to deactivate the lockout feature, the odds of the gas lockout feature being successfully deactivated by a child or disabled adult can be dramatically reduced, if not practically eliminated.

In alternative embodiments, it is contemplated that other keypad arrangements, including greater or fewer keypads and a numeric input keypad (e.g., numbered keys labeled 0 through 9 on key scripts) or icons to directly input cooking parameters in lieu of slew keys, could be used within the scope of the present invention for accessing and selecting features of a particular oven. In addition, if a numerical keypad is included, a coded number sequence could be employed to deactivate the gas lockout feature.

Figure 6:
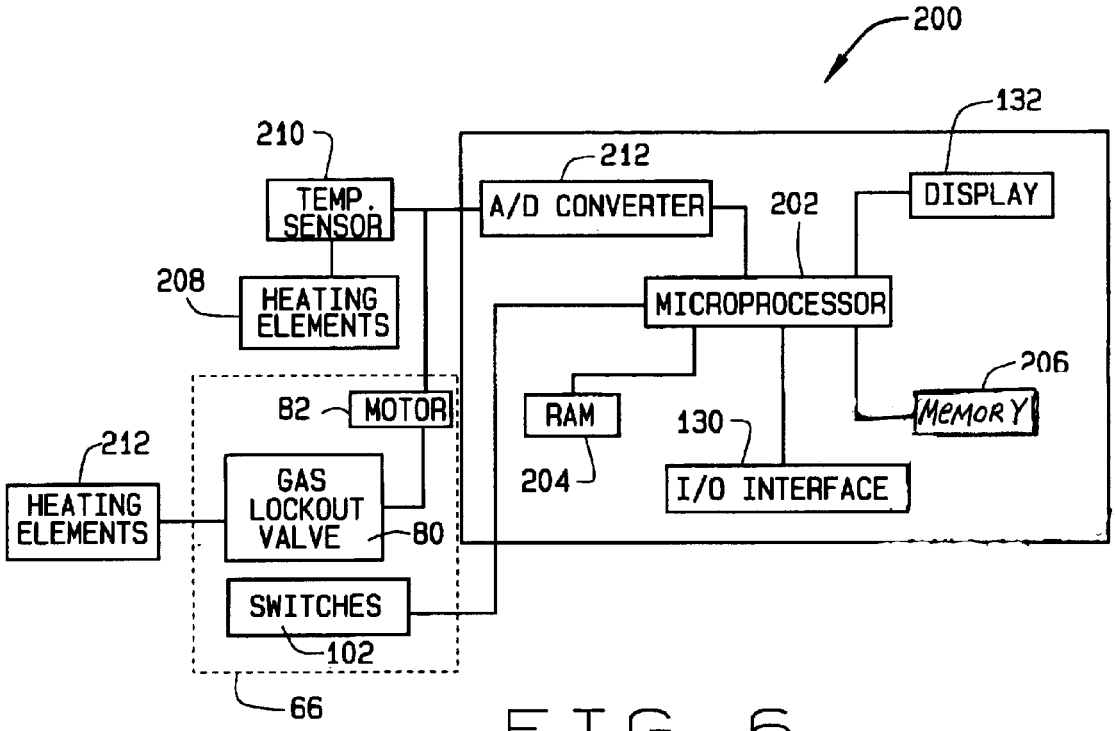
FIG. 6 is a schematic block diagram of a control system for the range shown in FIGS. 1 and 2.

FIG. 6 is a block diagram of a control system 200 for range 10 (shown in FIGS. 1 and 2) including a controller including a microprocessor 202 coupled to input interface 130 and to display 132, and including a RAM memory 204 and permanent memory 206, such a flash memory (FLASH), programmable read only memory (PROM), or an electronically erasable programmable read only memory (EEPROM) as known in the art. The controller memory is used to store calibration constants, oven operating parameters, cooking routine recipe information, etc. required to control the oven heating elements and execute user instructions.

Microprocessor 202 is operatively coupled to electrical heating elements 208 (i.e., oven bake element, broil element, convection element, and cooktop surface heating units) for energization thereof through relays, triacs, or other known mechanisms (not shown) for cycling electrical power to oven heating elements. One or more temperature sensors 210 sense operating conditions of oven heating elements 208 and are coupled to an analog to digital converter (A/D converter) 212 to provide a feedback control signal to microprocessor 202. It is contemplated also that gas heating elements may be employed for oven operation in alternative embodiments of the invention.

In addition gas lockout valve assembly 66 is coupled to gas heating elements (such as burners 22, 24, 26, 28 shown in FIG. 1) for regulating a gas supply thereto as described above. Valve assembly 66 is operatively coupled to microprocessor 202 and is responsive thereto. When the gas lockout feature is selected through user manipulation of I/O interface 130, microprocessor signals valve assembly 66, and more specifically, microprocessor energizes motor 82 to close valve 80. When the gas lockout feature is deselected through user manipulation of I/O interface 130, microprocessor signals valve assembly 66, and more specifically, microprocessor energizes motor 82 to open valve 80. Microswitches 102, 104 (shown in FIG. 4) provide feedback to microprocessor 202 indicative of an opened or closed state of valve 80, and microprocessor 202 causes appropriate visual indicia via interface 130 and/or audible signals to alert a user of the gas lockout condition when the gas lockout feature is activated. By monitoring a state of switches 102, 104 fault conditions, such as motor failure or switch failure, can be detected and indicated to a user.

A low cost, reliable, and secure gas lockout valve assembly and system is therefore provided to prevent dangerous cooking appliance operation by persons who are unable to safely use and monitor the oven, and also that avoids power failure concerns and power restoration issues of known solenoid actuated lockout valves.

Figure 7:
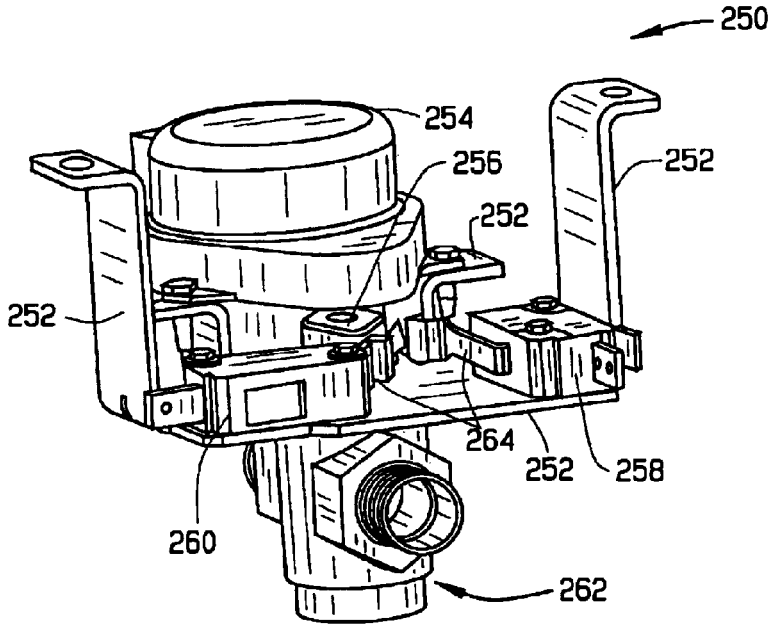
FIG. 7 is a perspective view of a second embodiment of a gas lockout valve assembly for the range shown in FIGS. 1 and 2.

FIG. 7 is a perspective view of a second embodiment of a motorized gas lockout valve assembly 250 that may be used in lieu of lockout valve assembly 66 (shown in FIGS. 3 and 4) in range 10 (shown in FIGS. 1 and 2) to prevent unsafe operation of gas heating elements therein.

Valve assembly 250 includes a mounting plate 252, a motor 254, a cam 256, microswitches 258, 260 for detecting a position of cam 256, and a valve 262 actuated by motor 254 through cam 256 for opening and closing a gas flow path therethrough. Unlike valve assembly 66, contact arms 264 or microswitches 258, 260 are positioned substantially 90° from one another about a diamond shaped cam 256 (described below) that contacts switch contact arms 264 only in certain positions, as opposed to cam 90 (shown in FIG. 4) in sliding engagement with switch contact arms 106, 108 in all positions of the cam. As such, the switch contact arms need not be biased against a surface of the cam, and consequently a more reliable and less costly switch arrangement is provided.

Figure 8:
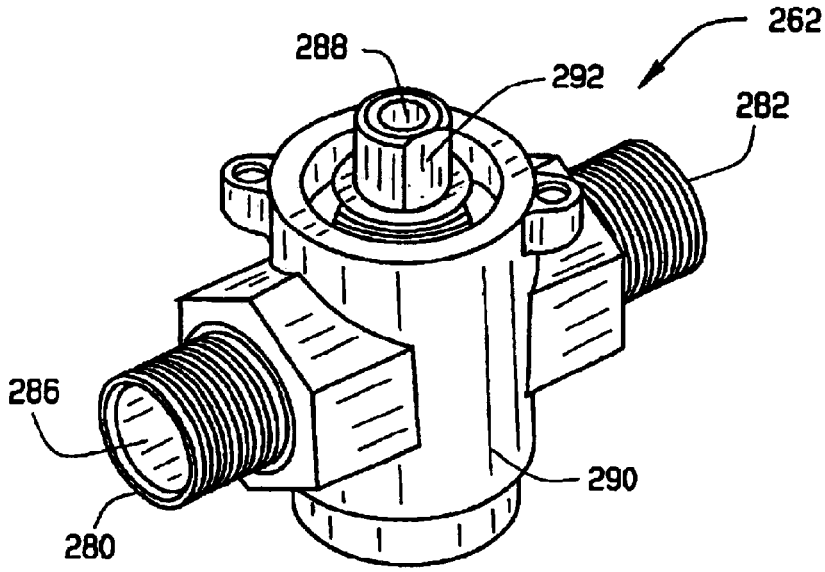
FIG. 8 is a perspective view of a valve for the valve assembly shown in FIG. 7.

FIG. 8 is a perspective view of valve 262 for valve assembly 250 (shown in FIG. 7). Valve 262 includes an inlet 280, an outlet 282, and a flow path 286 extending between inlet 280 and outlet 282. In an exemplary embodiment, inlet 280 and outlet 282 are adapted for threaded connection to a gas line, such as gas line 70 (shown in FIG. 2), and a valve stem or valve actuator shaft 288 extends upward from a valve body 290 between inlet 280 and outlet 282. A tapered plug valve member (not shown) is situated within valve body 290 and is movable in the flow path via rotation of valve actuator shaft 288 to regulate fluid communication between inlet 280 and outlet 282. It is believed that the construction and operation of plug valves, such as valve 290, are within the purview of those in the art without further explanation.

In an exemplary embodiment, valve actuator shaft 288 includes opposite flat outer surfaces 292 (only one of which is illustrated in FIG. 8} extending on either side thereof. Flat surfaces 292, as further explained below, facilitates actuation of valve shaft 288 with motor 254 (shown in FIG. 7).

Figure 9:
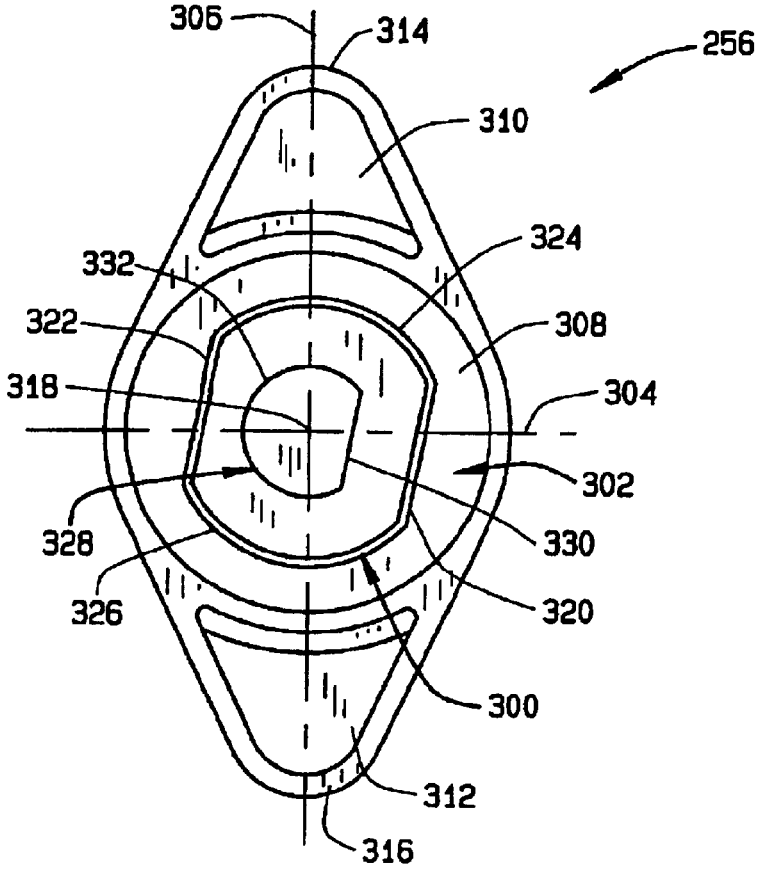
FIG. 9 is a top plan view of a cam for the valve assembly shown in FIG. 7.

FIG. 9 is a top plan view of cam 256 that receives an output shaft (not shown in FIG. 9) of motor 254 (FIGS. 7 and 8) and rotates therewith. Cam 256 includes a raised or elevated valve engagement portion 300 extending upward from a switch actuator portion 302. Switch actuator portion 302 is generally symmetrical about a lateral axis 304 and a longitudinal axis 306 and includes a substantially circular center portion 308 and oppositely extending web portions 310, 312 extending on either side thereof. In an exemplary embodiment, web portions 310, 312 are arch-shaped and extend from a rim of cam center portion 308, thereby imparting an overall rounded diamond shape to cam 256. It is appreciated, however, the other shapes of cam 256 may likewise be employed in alternative embodiments.

Cam web portions 310, 312 include rounded high points 314, 316, respectively, extending radially along cam longitudinal axis 306. As cam 256 is rotated about its center 318, high points 314, 316 contact switch contact arms 264 (shown in FIG. 7) so that a signal may be sent to a controller, such as microprocessor 202 (shown in FIG. 6) indicative of a position of cam, and, in turn, indicative of a position of valve actuator shaft 288 (shown in FIG. 8).

Valve engagement portion 300 includes opposite flat sides 320, 322 and opposite curved sides 324, 326 extending from and between opposite ends of flat sides 320, 322. Flat sides 320, 322 are angled with respect to cam longitudinal axis 306 and are substantially parallel to one another, while curved sides 324, 326 extend substantially parallel to an outer rim of cam center portion 308. Additionally, a motor shaft engagement bore 328 extends through cam valve engagement portion 300 and cam center portion 308. Bore 328 includes a flat side 330 and a curved side 332 extending between opposite ends of flat side 330. Bore flat side 330 extends substantially parallel to valve engagement portion flat side 320, and curved side 332 extends concentrically with the outer rim of cam center portion 308.

In use, cam 256 receives the motor output shaft within bore 328 on one side of the cam within valve engagement portion 300, and receives valve actuator shaft 288 (shown in FIG. 8) on the other side of the cam. A positive driving engagement is therefore established between flat surfaces of the motor shaft, valve shaft 288, and bore flat side 330. It is recognized, however, that other shapes and configurations of bore 328, valve shaft 288 and the motor output shaft may be employed in alternative embodiments to establish a driving relation between the motor shaft and valve shaft 288, such as with splines, keying arrangements, tongue-in-groove arrangements, etc.

Figure 10:
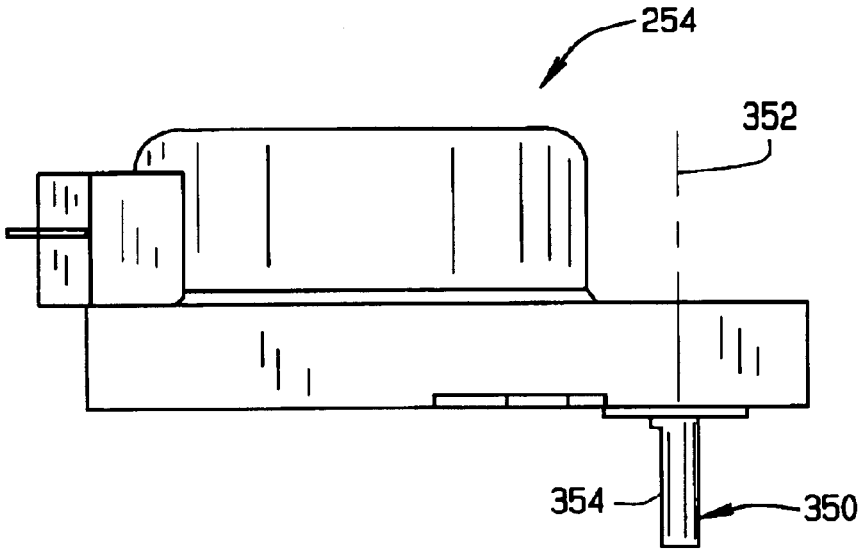
FIG. 10 is an elevational view of a motor for the valve assembly shown in FIG. 7.

FIG. 10 is an elevational view of motor 254 illustrating a motor shaft 350 extending therefrom and rotatable about a shaft axis 352 when motor 254 is energized. Motor shaft 350 in an illustrative embodiment is a generally cylindrical shaft including a flat surface 354 extending on one side thereof. As noted above, when motor shaft 350 is received within cam bore 328 (shown in FIG. 9), cam 256 (shown in FIG. 9) is coupled to shaft 350 and rotates therewith. In one embodiment, motor 254 is a known AC synchronous gear-motor generating a low revolutions per minute rotation of motor shaft 350 when energized. In a particular embodiment, motor 254 operates in single digit revolutions per minute (and two revolutions per minute in a specific embodiment) although it is appreciated that a variety of motor speeds may be employed in the instant invention.

Figure 11:
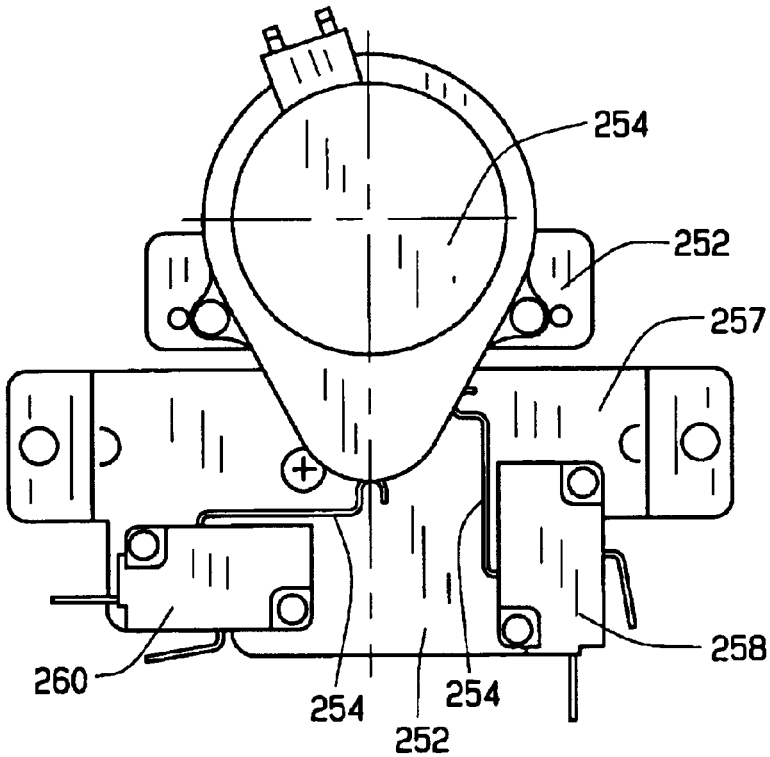
FIG. 11 is a top plan view of the valve assembly shown in FIG. 7.

FIG. 11 is a top plan view of motorized lockout valve assembly 250. Motor 254 and switches 258, 260 are each coupled to mounting plate 252 with known fasteners. Cam 256 (shown in FIGS. 7 and 9) is coupled to motor shaft 350 (shown in FIG. 10) and to valve shaft 288 (shown in FIG. 8). When motor 254 is energized, motor output shaft causes cam 256 and valve shaft 288 to rotate, thereby opening and closing of valve 262 (shown in FIGS. 7 and 8) beneath mounting plate 252. Rotation of cam 256 causes cam high points 314, 316 (shown in FIG. 9) to displace switch contact arms of respective microswitches 258, 260, thereby activating switches 258, 260 for a determination of an operating position or state (i.e., opened or closed) of valve 262.

Motorized lockout valve assembly 250 may be operated and controlled substantially as described above in relation to valve assembly 66. Like valve assembly 66, valve assembly 250 provides a low cost, reliable, and secure gas lockout valve assembly to prevent dangerous cooking appliance operation by persons who are unable to safely use and monitor the oven, and also that avoids power failure concerns and power restoration issues of known solenoid actuated lockout valves.

While the invention has been described in terms of various specific embodiments, those skilled in the art will recognize that the invention can be practiced with modification within the spirit and scope of the claims.

What is claimed is:

1. A gas cooking appliance, comprising:

at least one gas cooking element, said cooking element including a control knob operable to regulate a gas flow to said cooking element; and a gas lockout valve assembly in line with said at least one gas cooking element, said gas lockout valve assembly comprising a valve and a single digit rpm motor configured to open or close the valve, wherein said control knob remains operable to regulate gas flow to said cooking element during a power loss and without power backup when said gas lockout valve is open during said power loss.

2. A gas cooking appliance in accordance with claim 1 further comprising a rotatable cam adapted to indicate a position of said valve.

3. A gas cooking appliance in accordance with claim 2 further comprising at least one microswitch in communication with said cam.

4. A gas cooking appliance in accordance with claim 3 further comprising a controller coupled to said motor.

5. A gas cooking appliance in accordance with claim 4 wherein said controller comprises a microprocessor.

6. A gas cooking appliance in accordance with claim 1 wherein said at least one gas cooking element comprises a plurality of gas cooking elements, said appliance further comprising a gas manifold connected between said gas lockout valve assembly and said plurality of gas cooking elements.

7. A gas fired cooktop comprising:

at least one gas burner;

at least one control knob associated with said at least one burner; and a motorized gas lockout valve coupled to said at least one gas burner and establishing a gas supply connection thereto, said valve positionable between an open position whereby said control knob is effective to operate said burner and a gas lockout position, thereby rendering said control knob ineffective to operate said burner, and wherein said control knob remains effective to operate said burner during a power loss and without power backup when said gas lockout valve is in said open position during said power loss.

8. A gas fired cooktop in accordance with claim 7 wherein said motorized gas lockout valve comprises:

a valve;

a motor coupled to and in driving relation to said valve, said motor opening and closing a flow path through said valve; and a cam coupled to said valve and indicating a state of said valve.

9. A gas fired cooktop in accordance with claim 8 further comprising a switch indicating a position of said cam.

10. A gas fired cooktop in accordance with claim 9 further comprising a microprocessor coupled to said switch, said microprocessor configured to indicate a state of said switch to a user based upon a position of said cam.

11. A gas cooktop in accordance with claim 7 further comprising a gas manifold coupled between said at least one said burner and said gas lockout valve.

12. A gas range comprising:

a cabinet;

a plurality of gas heating elements coupled to said cabinet, each of said plurality of heating elements including a control knob operable to regulate a gas flow to said heating element;

a gas manifold within said cabinet and configured to distribute gas to each of said heating elements; and a motorized gas lockout assembly coupled in line with said gas manifold, said motorized gas lockout assembly positionable to permit or deny gas flow to said gas manifold, and wherein each said control knob remains operable to regulate gas flow to a respective one of said heating elements during a power loss and without power backup when said gas lockout valve is positioned to permit gas flow during said power loss.

13. A gas range in accordance with claim 12 further comprising a microprocessor coupled to said motorized lockout valve assembly, said microprocessor configured to sense a position of said valve assembly.

14. A gas range in accordance with claim 13 further comprising a display configured to indicate a state of said valve assembly.

15. A gas range in accordance with claim 13 further comprising a switch coupled to said microprocessor, said switch actuated by said valve assembly as said valve assembly is positioned.

16. A gas range in accordance with claim 15, said gas lockout valve comprising a cam configured to actuate said switch.

17. A gas range in accordance with claim 12, said motorized gas lockout valve assembly comprising a single digit rpm motor.

18. A gas range in accordance with claim 12, said valve comprising a plug valve.

19. A gas range comprising:

a cabinet;

a plurality of gas heating elements coupled to said cabinet;

a gas manifold within said cabinet and configured to distribute gas to each of said heating elements; and a gas lockout assembly coupled in line with said gas manifold, said gas lockout assembly comprising:

a valve;

a motor coupled to and in driving relation to said valve, said motor opening and closing a flow path through said valve to permit or prevent gas flow to said gas manifold, and wherein said valve remains open to permit gas flow to said gas manifold during a power loss and without power backup when said valve is open when said power loss occurs; and a cam coupled to said valve and indicating a position of said valve.

20. A gas range in accordance with claim 19 wherein said valve is a plug valve.

* * * * *